United States Patent [19]

Wagenknecht

[11] 4,026,771

[45] May 31, 1977

[54] PROCESS FOR THE PURIFICATION OF METALS

[75] Inventor: John H. Wagenknecht, Kirkwood, Mo.

[73] Assignee: Monsanto Company, St. Louis, Mo.

[22] Filed: Oct. 30, 1975

[21] Appl. No.: 627,437

[52] U.S. Cl. ..... 204/105 R
[51] Int. Cl.[2] ..... C25C 1/00; C25C 1/22
[58] Field of Search ..... 204/140, 130, 105 R

[56] References Cited

UNITED STATES PATENTS 2,093,406 9/1937 Atkinson ..... 204/39

OTHER PUBLICATIONS

"Electrodep. of Ir from Fused NaCN & Aqueous Electrolytes" by R. L. Andrews et al., U.S. Bur. of Mines R.I. No. 7023, 9/1967, pp. 6–8.

*Primary Examiner*—R. L. Andrews
*Attorney, Agent, or Firm*—Peter S. Gilster; Lawrence L. Limpus

[57] ABSTRACT

A method and apparatus to electrochemically purify gallium is disclosed where a platinum anode is inserted into an electrolytic cell which contains the unpurified gallium as an anode and the purified gallium as a cathode, the platinum anode serving to reduce the gallium ion level in the electrolyte addition.

2 Claims, 3 Drawing Figures

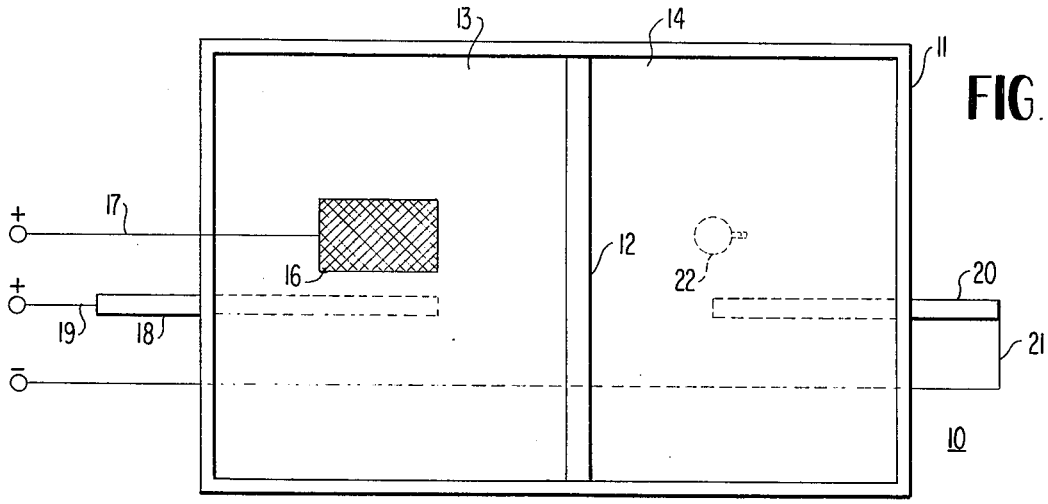
FIG. 1
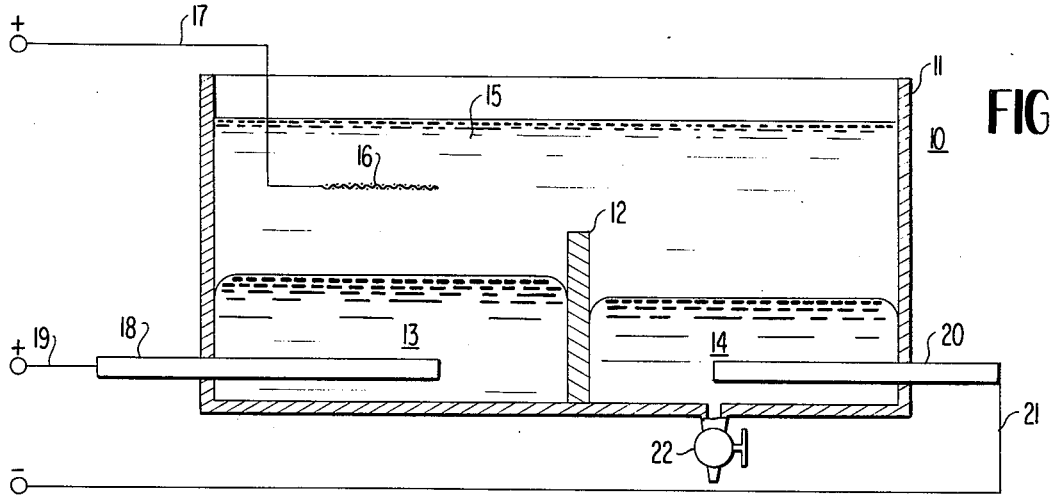
FIG. 2
FIG. 3
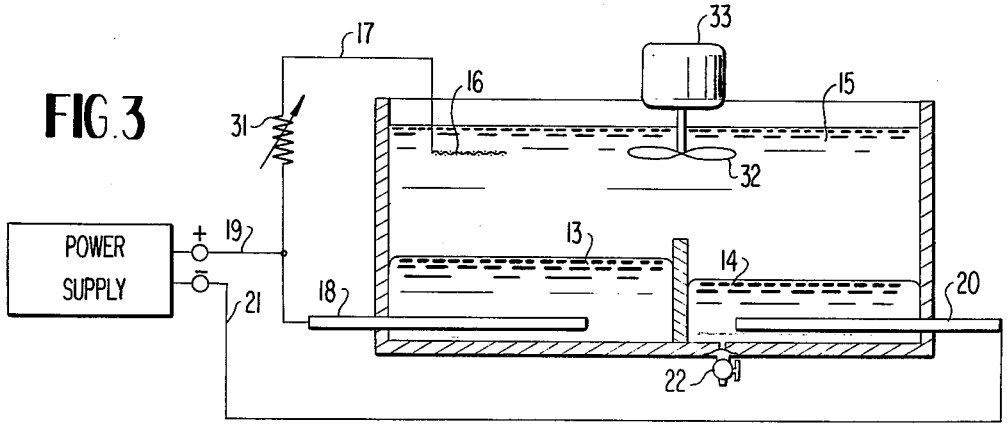

PROCESS FOR THE PURIFICATION OF METALS

BACKGROUND OF THE INVENTION

The invention relates to a method and apparatus for electrolytic purification of metals. An electrolysis is carried out from an impure metal anode to a pure metal cathode wherein impurities more electronegative than the metal to be purified remain at the anode terminal. Where the metal is gallium, which is used in light-emitting diode construction and has a low melting temperature, the process is carried out with the metal essentially molten in form.

The basic process of electrochemical purification of gallium uses electrolyte in conjunction with electrodes of pure and impure gallium such that a current flow transports the gallium ions from an impure supply of gallium to the pure supply. The purification of gallium by electrolysis from anode to cathode allows the removal of all metals more electronegative than gallium. Thus, for example, Ag, As, Cd, Co, Cr, Cu, Fe, Hg, Mn, Ni, Pb and Sn will not electrooxide at the gallium oxidation potential in a basic solution. These metals should remain in the impure anode gallium supply if the potential of the anode does not significantly exceed the gallium oxidation potential. The basic process of electrochemical purification of gallium is described in an article by Lysenko and Tsyb, entitled "Removal of Micro-impurities from Gallium", J. Appl. Chem., USSR 38 (3), 501 (1965). 38 (3), 501 (1965).

In attempting to apply this process to the present day need to recycle scrap gallium, there are several difficulties which prohibit the application of this process for the production of semiconductor quality gallium. Impurity levels on the order of a few parts per million were about the best possible with the Lysenko process whereas present semiconductor technology requires impurity levels at or below a few parts per billion. Additionally, the phenomenon of passivation of the gallium anode occurs; that is, chemical dissolution of gallium into the solution increasing the gallium level such that eventually the gallium oxide compounds increase the resistance of the cells to an extent that current will no longer flow. This necessitates completely changing the electrolyte fluid and results in a loss of the gallium dissolved therein. Since it is economically unfeasible to throw away this gallium, a separate process must be utilized to recover the dissolved gallium from the discarded electrolyte. Therefore, the need arose for both a method and an apparatus whereby gallium could be continuously electrochemically purified without constantly changing electrolytes with a degree of purity that is suitable for present day semiconductor technology.

SUMMARY OF THE INVENTION

Accordingly, it is an object of the present invention to provide a method of electrochemically refining gallium which does not require continued changes of electrolytic fluid.

A further object is to provide an apparatus whereby molten gallium can be continuously electrochemically refined without the need to periodically change the electrolyte.

A still further object is to improve the purity of existing electrochemical refining processes to that required in the manufacture of electroluminescent semiconductors, i.e., impurities on the order of a few parts per billion only.

According to the present invention, the foregoing and other objects are attained by the method of adding an additional platinum anode to the electrochemical purification cell. This increases the rate of electrochemical deposition at the cathode which then equals the combined dissolution due to electrochemical and chemical reactions. This second anode allows the metal ion level in the electrolyte to remain at a constantly low lever and eliminates the necessity of changing electrolytes. The apparatus for accomplishing the above method has a platinum electrode inserted into the electrolyte and electrically connected in parallel with the anode of the metal to be purified.

BRIEF DESCRIPTION OF THE DRAWINGS

A more complete appreciation of the invention and many of the attendant advantages thereof will be readily apparent as the same becomes better understood by reference to the following description when considered in connection with the accompaying drawings wherein:

FIG. 1 is a plan view of an electrolytic cell according to the invention;

FIG. 2 is a side cross-sectional view of the cell in FIG. 1; and

FIG. 3 is a diagrammatical illustration, partially in cross- section, showing the operation of the electrolytic cell.

DETAILED DESCRIPTION OF THE PREFERRED EMBODIMENT

Reference is now made to the drawings wherein like numerals designate identical parts throughout the several views. In FIGS. 1 and 2, the electrolytic purification cell 10 consists of an inert container 11 with an inert divider 12 making two compartments to contain the impure gallium 13 and the refined gallium 14. These separate chambers are connected through electrolyte 15 in which is immersed a platinum screen anode 16 connected to anode lead 17. The impure gallium 13 is electrically connected through graphite anode 18 to anode lead 19. The pure gallium 14 is connected through graphite cathode 20 to cathode lead 21. Pure gallium may be drained off through stopcock 22.

FIG. 3 shows a preferred embodiment as connected to a power supply with a variable resistor 31 connected between platinum anode lead 17 and gallium anode lead 19. A circulation propeller 32 immersed in the electrolyte 15 is rotated by motor 33.

A current is induced to flow from the anode 18 to the cathode 20 by means of the power supply. By convention, current flow is from + to −. Thus, the current flow is from the surface of the impure gallium 13 through the electrolyte 15 to the surface of the pure gallium 14, that is, gallium ions are transported from the impure gallium 13 to the pure gallium 14 through the electrochemical process. Normally, the rate of electrochemical dissolution would equal the rate of electrochemical plating of gallium and therefore the gallium ion level in the electrolyte would remain constant. However, in addition to the electrochemical dissolution there is a chemical dissolution of gallium into the basic electroylte which causes a gradual increase in the gallium level in the solution. This increase will eventually reach a level which increases the cell resistance thereby decreasing the current flow and plating action unless the voltage is increased. But if the voltage is increased beyond the electronegative potential of gallium, other impurities will be dissolved and plated out also. Thus, a limiting factor is reached precluding further plating of gallium. This necessitates completely changing the electrolyte to reduce the gallium concentration and, since gallium is a precious metal, the contaminated electrolyte then must be separately reduced to obtain as much of the dissolved gallium as is possible. The inclusion of the additional platinum anode 16 in the electrolyte cell permits the recovery of gallium directly in the purification cell. In addition to the plating of the electrochemically dissolved gallium, the platinum anode promotes the plating of the chemically dissolved gallium, thus maintaining the gallium ion level of the electrolyte solution at a constant concentration. This then eliminates the need for replacing the electrolyte periodically and does away with the additional requirement of externally refining the discarded electrolyte to obtain the gallium dissolved therein. Essentially, when potassium hydroxide is used in the electrolyte solution, the platinum anode in the purification cell regenerates KOH by the following reactions;

Pt anode: $3/2H_2O - 3e^- \rightarrow 3/4\sigma_2 + 3H^+$

Cathode: $H_2GaO_3{}^-K^+ + H_2O + 3e^- \rightarrow Ga + KOH + 3\sigma H^-$

Overall reaction: $H_2GaO_3{}^-K^+ \rightarrow Ga + 3/4\sigma_2 + KOH + 1/2H_2O$ Thus, it can be seen that the overall result is the removal of gallium from solution with regeneration of the potassium hydroxide electrolyte along with oxygen evolution which has no detrimental affect on the cell.

In a preferred embodiment, an electrolyte of 25%, by weight, KOH was used, although lesser concentrations could be used. A higher strength of electrolyte will result in the formation of a precipitate which after coating the gallium surfaces will prevent current flow. The optimum current flow was 0.66 amps/square inch of surface of the gallium cathode exposed to the liquid electrolyte. To ensure the best possible contact with the gallium metal, the graphite anode and cathode should be positioned such that they are surrounded by the gallium and are not in contact with the bottom of the cell or the electrolyte fluid.

It can be seen that there are many variations of the above apparatus and process possible. For instance, it could be used to refine metal other than gallium and, using different electrolytes and different circuitry, it could be used not only to refine out more electronegative metals than gallium as in the present process, but also to refine out more electropositive metals. Although the invention has been described relative to a specific embodiment thereof, it is not so limited and many modifications and variations thereof will be readily apparent to those skilled in the art in light of the above teachings. It is therefore understood that within the scope of the appended claims, the invention may be practiced otherwise than as specifically described.

What is claimed is:

1. A method for electrochemical refining of a metal, said method including the step of immersing impure metal in an electrolyte, immersing a sample of purified metal in said electrolyte, said purified metal being physically separated by means inert ot said metal from said impure metal, and electrically connecting said metals to an electric current source such that pure metal is electrochemically and chemically dissolved from said impure metal and deposited on said pure metal, said improvement comprising the step of:

immersing a platinum electrode in said electrolyte, said electrode being an anode as is the impure metal such that the current passing from said platinum anode causes an increase of current at the cathode of pure metal in addition to the current provided by said impure metal anode said current increase being large enough to deposit the chemically dissolved metal whereby the rate of electrochemical deposition of pure metal is increased to equal the rate of electrochemical and chemical dissolution of said impure metal.

2. The method of claim 1 wherein the improvement comprises the additional step of circulating said electrolyte around said metal to increase said refining efficiency.

* * * * *